US008201755B2

(12) United States Patent
Shanklin et al.

(10) Patent No.: US 8,201,755 B2
(45) Date of Patent: Jun. 19, 2012

(54) SINGLE VALVE READY TO USE SPRAYER

(75) Inventors: Donald J. Shanklin, Corona, CA (US); Ronald F. Englhard, Dove Canyon, CA (US)

(73) Assignee: MeadWestvaco Calmar, Inc., Richmond, VA (US)

( * ) Notice: Subject to any disclaimer, the term of this patent is extended or adjusted under 35 U.S.C. 154(b) by 957 days.

(21) Appl. No.: 11/062,171

(22) Filed: Feb. 18, 2005

(65) Prior Publication Data

US 2005/0184171 A1 Aug. 25, 2005

Related U.S. Application Data

(60) Provisional application No. 60/546,552, filed on Feb. 20, 2004.

(51) Int. Cl.
*B05B 7/30* (2006.01)

(52) U.S. Cl. ..... 239/318; 239/583; 239/586

(58) Field of Classification Search ..... 239/310, 239/316, 318, 319, 413–415, 583, 586
See application file for complete search history.

(56) References Cited

U.S. PATENT DOCUMENTS

| | | | | |
|---|---|---|---|---|
| 667,491 | A | | 2/1901 | Brigham |
| 1,813,581 | A | | 7/1931 | Rodrigues |
| 2,462,752 | A | * | 2/1949 | Kotches ..... 239/312 |
| 2,571,871 | A | | 10/1951 | Hayes |
| 2,719,704 | A | | 10/1955 | Anderson et al. |
| 2,764,452 | A | | 9/1956 | Anderson et al. |
| 2,788,244 | A | | 4/1957 | Gilmour |
| 2,837,374 | A | | 6/1958 | Lipman |
| 3,064,683 | A | | 11/1962 | Nordstrand |
| 3,090,564 | A | | 5/1963 | Gilmour |
| 3,122,325 | A | | 2/1964 | Mahrt et al. |
| 3,134,545 | A | | 5/1964 | Armond |
| 3,180,580 | A | | 4/1965 | Schedel |
| 3,186,643 | A | | 6/1965 | George et al. |
| 3,207,443 | A | | 9/1965 | Gilmour |
| 3,212,716 | A | | 10/1965 | Mills et al. |
| 3,231,200 | A | | 1/1966 | Heald |
| 3,254,844 | A | | 6/1966 | Blasnik et al. |
| 3,258,026 | A | | 6/1966 | Weaver |
| 3,291,395 | A | | 12/1966 | Sharp |
| 3,628,732 | A | * | 12/1971 | Vicari ..... 239/310 |
| 3,632,083 | A | | 1/1972 | Meeks |
| 3,764,074 | A | | 10/1973 | James |
| 3,768,777 | A | | 10/1973 | Hechler |
| 3,770,205 | A | | 11/1973 | Proctor et al. |
| 3,809,124 | A | | 5/1974 | Nelson |
| 3,940,069 | A | | 2/1976 | Gunzel, Jr. et al. |
| 4,008,878 | A | | 2/1977 | Himmelman et al. |
| RE29,405 | E | | 9/1977 | Gunzel, Jr. et al. |
| 4,121,773 | A | | 10/1978 | Headen et al. |
| 4,138,033 | A | | 2/1979 | Payne et al. |
| 254,146 | A | | 2/1980 | Koenig |
| 4,281,796 | A | | 8/1981 | Fugent et al. |
| 4,349,157 | A | | 9/1982 | Beiswenger et al. |

(Continued)

*Primary Examiner* — Christopher Kim
(74) *Attorney, Agent, or Firm* — MWV Intellectual Property Group

(57) ABSTRACT

A sprayer head assembly for dispensing a chemical stored within a container comprises a body having a bore and a valve moveably positioned at least partially within the bore. The sprayer head assembly includes passages for the carrier fluid and the chemical. A vent passage is also provided. The valve selectively closes and opens the carrier fluid, chemical and vent passages. The valve is configured to move in a side to side motion which is generally transverse to a longitudinal axis of the assembly.

15 Claims, 24 Drawing Sheets

U.S. PATENT DOCUMENTS

| | | | |
|---|---|---|---|
| 4,369,921 | A | 1/1983 | Beiswenger et al. |
| 4,475,689 | A | 10/1984 | Hauger et al. |
| 4,508,272 | A | 4/1985 | Thompson |
| 4,595,127 | A | 6/1986 | Stoody |
| 4,640,461 | A | 2/1987 | Williams |
| 4,651,930 | A | 3/1987 | Magaha, Jr. |
| 4,736,891 | A | 4/1988 | Chow et al. |
| 4,750,674 | A | 6/1988 | Chow et al. |
| 4,767,058 | A | 8/1988 | LaRosa et al. |
| 4,811,900 | A | 3/1989 | LaRosa et al. |
| 4,826,085 | A | 5/1989 | Chow et al. |
| 4,838,490 | A | 6/1989 | Nissels |
| 4,878,619 | A | 11/1989 | Norman |
| 4,881,575 | A | 11/1989 | Smith |
| 4,901,923 | A | 2/1990 | McRoskey et al. |
| 4,901,976 | A | 2/1990 | Smith |
| 4,969,603 | A | 11/1990 | Norman |
| 5,007,588 | A | 4/1991 | Chow et al. |
| 5,039,016 | A | 8/1991 | Gunzel, Jr. et al. |
| 5,100,059 | A | 3/1992 | Englhard et al. |
| 5,152,464 | A | 10/1992 | Farley |
| 5,213,264 | A | 5/1993 | Styne |
| 5,213,265 | A | 5/1993 | Englhard et al. |
| 5,320,288 | A | 6/1994 | Ketcham, Jr. |
| 5,356,076 | A | 10/1994 | Bishop |
| 5,372,310 | A | 12/1994 | Ketcham |
| 5,383,603 | A | 1/1995 | Englhard et al. |
| 358,865 | A | 5/1995 | Englhard et al. |
| 5,595,345 | A | 1/1997 | Chura et al. |
| 5,649,664 | A | 7/1997 | Brass et al. |
| 5,655,563 | A | 8/1997 | Johnson |
| 5,850,973 | A | 12/1998 | Liljeqvist et al. |
| 5,945,160 | A | 8/1999 | Kobak et al. |
| 5,954,272 | A | 9/1999 | Liao |
| 433,095 | A | 10/2000 | Beauer et al. |
| 6,267,304 | B1 | 7/2001 | Schultz |
| 451,581 | A1 | 12/2001 | Shanklin et al. |
| 6,345,773 | B1 | 2/2002 | Shanklin et al. |
| 6,378,785 | B1 | 4/2002 | Dodd |
| 6,425,534 | B2 | 7/2002 | Ketcham et al. |
| 6,471,141 | B2 | 10/2002 | Smith et al. |
| 6,578,776 | B1 | 6/2003 | Shanklin et al. |
| 6,651,901 | B2 | 11/2003 | Jones |
| 484,572 | A1 | 12/2003 | Shanklin et al. |
| 6,655,660 | B2 | 12/2003 | Wales |
| 6,672,520 | B2 | 1/2004 | Shanklin et al. |
| 6,726,123 | B2 | 4/2004 | Wang |
| 6,749,133 | B1 | 6/2004 | Ketcham et al. |
| 6,772,966 | B2 | 8/2004 | Foster et al. |
| 6,913,209 | B2 * | 7/2005 | Shanklin et al. ..... 239/318 |
| 2004/0118944 | A1 | 6/2004 | Amaduzzi |
| 2004/0124263 | A1 | 7/2004 | Seeman |
| 2004/0140372 | A1 | 7/2004 | Englhard et al. |

* cited by examiner

SINGLE VALVE READY TO USE SPRAYER

PRIORITY INFORMATION

This application claims the priority benefit under 35 U.S.C. §119(e) of Provisional Application 60/546,552 filed Feb. 20, 2004.

BACKGROUND OF THE INVENTION

1. Field of the Invention

The present invention relates to chemical dispensing sprayers and, in particular, to aspiration-type sprayers that use a relatively large amount of carrier fluid for dispensing a relatively small amount of a chemical solution.

2. Description of the Related Art

Every year consumers apply thousands of gallons of chemicals such as fertilizers or pesticides to plants, lawns, flowers, vegetable gardens and other organic type vegetation. Typically, such chemicals are sold in plastic containers in a concentrated form. While in this concentrated form, the chemical is extremely hazardous to the consumer end user and the environment in general. Accordingly, the container typically includes an aspiration-type sprayer head assembly. An aspiration-type sprayer uses a relatively large amount of carrier fluid, such as water, to withdraw, dilute and dispense a relatively small amount of chemical from the container. To further prevent harm to the consumer, the container and the sprayer head assembly are preferably disposed of after the container's contents are exhausted. It is therefore desirable to provide a sprayer head assembly that is sufficiently low cost so as to allow the entire unit to be discarded and yet reliable and safe.

SUMMARY OF THE INVENTION

It is therefore an object of one embodiment to provide a safe and reliable aspiration type chemical sprayer that utilizes a minimum number of components and that is relatively easy to manufacture and assemble.

Accordingly, one embodiment of the present invention comprises a chemical sprayer for dispensing a chemical from a container. The sprayer includes a body and a valve. The body comprises a bore, a chemical passage and a carrier fluid passage. The chemical passage is in communication with a cavity in the container. The carrier fluid passage is in communication with a carrier fluid source. The bore is in communication with the chemical passage and the carrier fluid passage. The carrier fluid passage extends generally in a first direction. A valve is moveably positioned at least partially within the bore. The valve at least partially defines a first passage and a second passage. The first passage and the second passage merge at the valve. The first passage is configured so as to be in communication with the chemical passage when the valve is in an open position. The second passage is configured so as to be in communication with the carrier fluid passage when the valve is in the open position. The first passage and the second passage are configured so as to not be in communication with the chemical and carrier fluid passages when the valve is in a closed position. The valve is configured such that as the valve moves between the open and closed positions, the valve moves along a second direction. The second direction extends generally traverse to the first direction. The valve further comprises one or more sealing portions positioned so as to block both the chemical passage and the carrier fluid passages when the valve is in the closed position.

All of these embodiments are intended to be within the scope of the invention herein disclosed. These and other embodiments of the present invention will become readily apparent to those skilled in the art from the following detailed description of the preferred embodiments having reference to the attached FIGS., the invention not being limited to any particular preferred embodiment(s) disclosed.

For purposes of summarizing the invention and the advantages achieved over the prior art, certain objects and advantages of the invention have been described herein above. Of course, it is to be understood that not necessarily all such objects or advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other objects or advantages as may be taught or suggested herein.

BRIEF DESCRIPTION OF THE DRAWINGS

These and other features of the invention will now be described with reference to the drawings of the preferred embodiments, which are intended to illustrate and not to limit the invention, and in which.

DETAILED DESCRIPTION OF THE PREFERRED EMBODIMENTS

Figure 10:
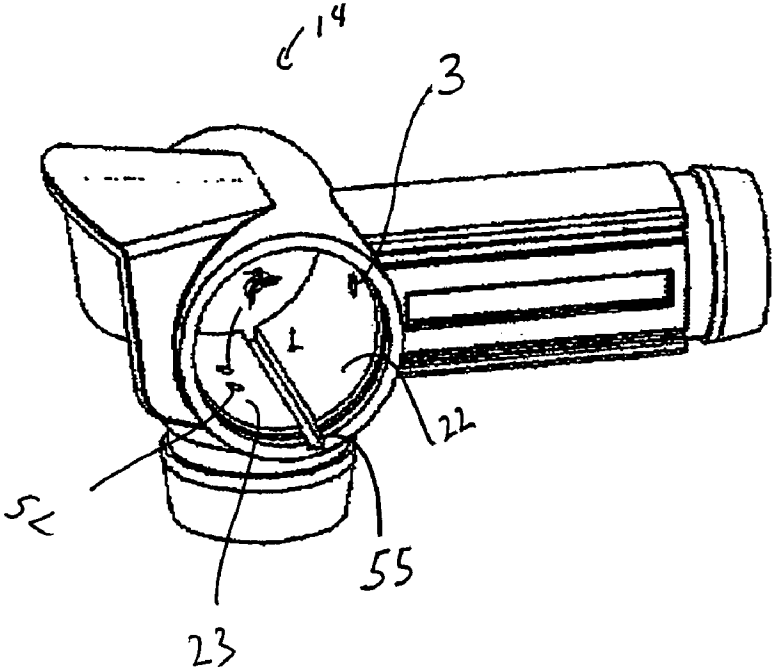
FIG. 10 is a side perspective view of the a sprayer head of the assembly of FIG. 1 with the valve removed.
Figure 11:
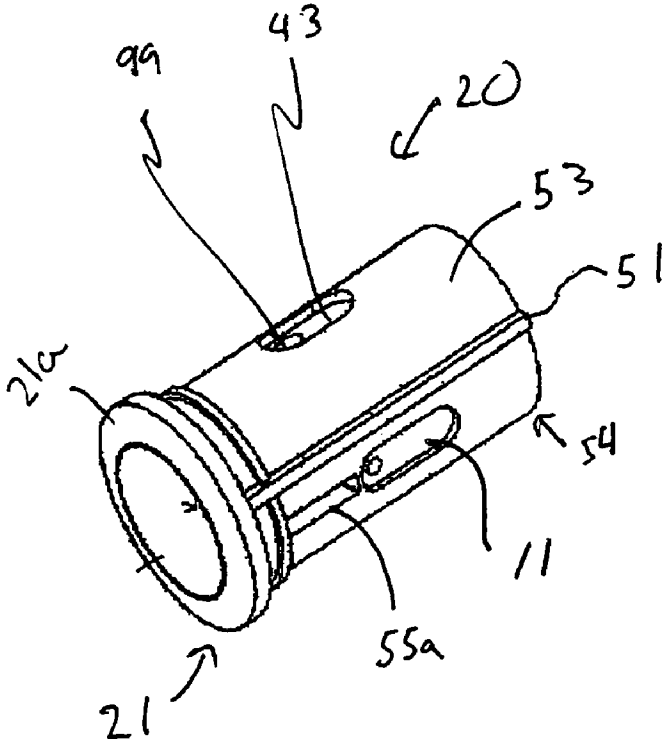
FIG. 11 is a bottom perspective view of the valve.
Figure 12:
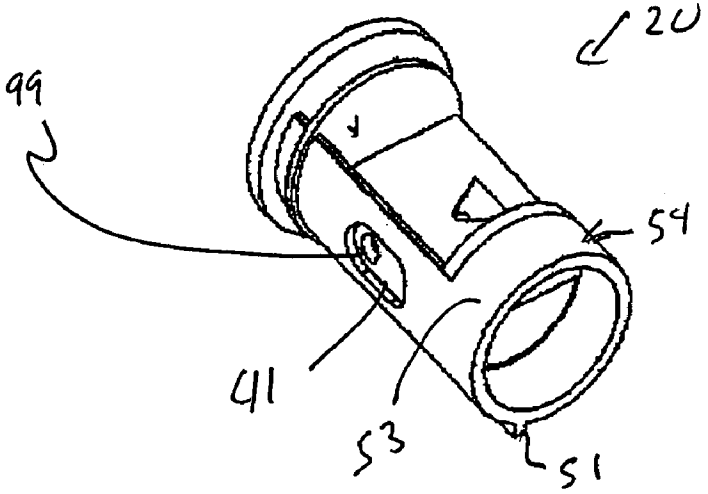
FIG. 12 is a top perspective view of the valve.
Figure 14:
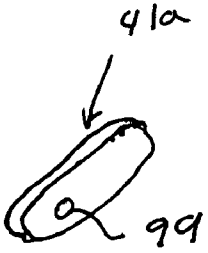
FIG. 14 is a side perspective view of a second sealing member of the assembly of FIG. 1.

FIGS. 1-14 illustrate an embodiment of a sprayer head assembly 10. FIGS. 1-4 illustrate the assembly in a closed position. FIGS. 5-9 show the assembly in an open position. FIG. 10 shows a sprayer head 14 of the assembly 10 without a valve 20 and FIGS. 11 and 12 show the valve 20 removed from the assembly 10.

Figure 1:
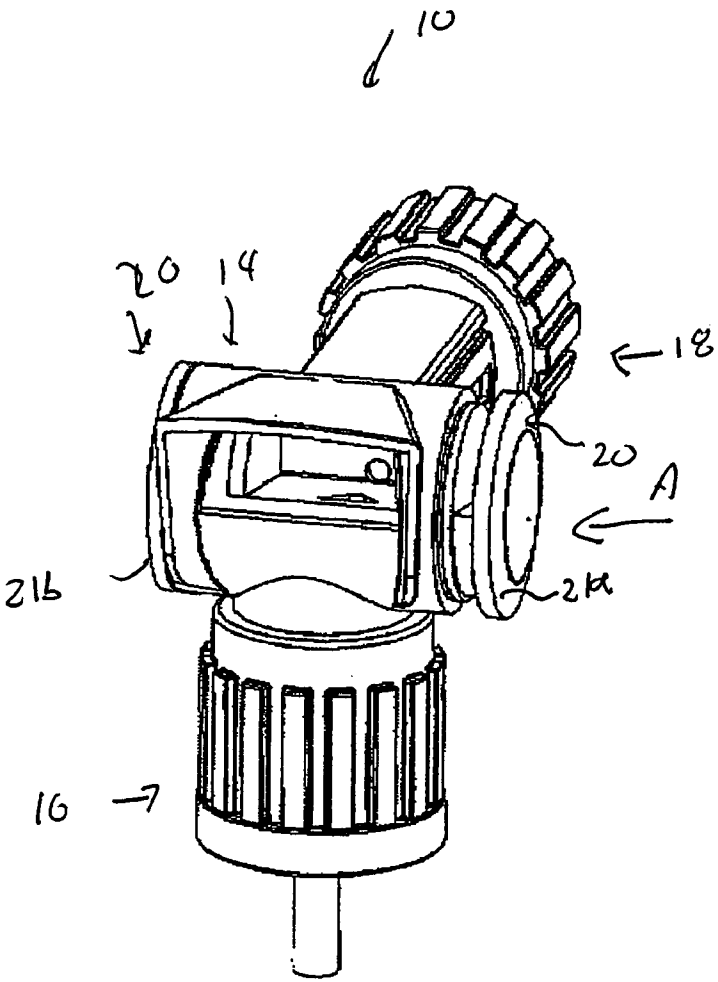
FIG. 1 is a front perspective view of a sprayer head assembly in a closed position.
Figure 2:
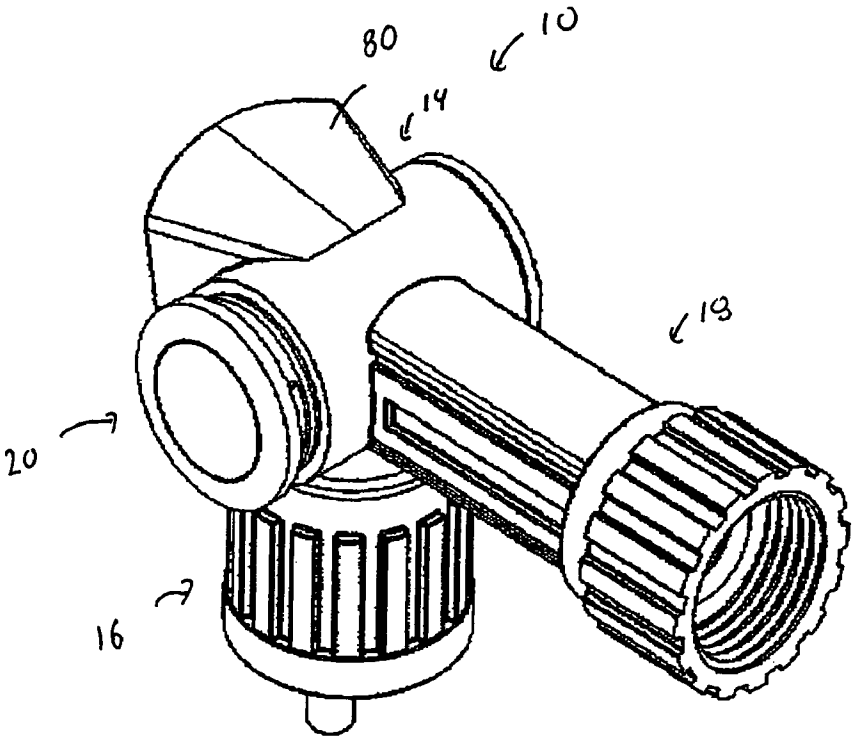
FIG. 2 is a rear perspective view of the sprayer head assembly of FIG. 1.

With reference to FIG. 1, the sprayer head assembly 10 includes a sprayer head 14, a container connection portion 16, a supply fluid connection portion 18, and a control valve 20. As will be explained below, the container connection portion 16 may be used to connect the assembly to a container that contains a chemical. The supply fluid connection portion 18 may be used to connect the assembly to a carrier fluid source, such as, for example, a garden hose. The sprayer head assembly 10 may be made of any suitable material that is resistant to and compatible with the chemical fluid to be sprayed. However, a flexible plastic material, such as polypropylene, is preferred because it is resilient yet durable.

Figure 3:
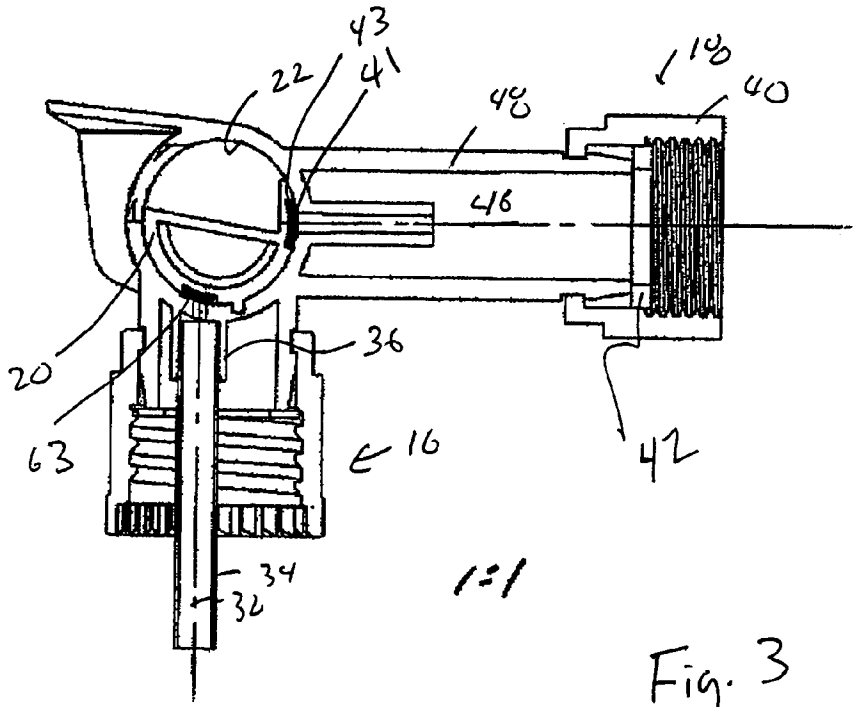
FIG. 3 is a cross-sectional side view of the sprayer head assembly of FIG. 1 in a closed position.
Figure 5:
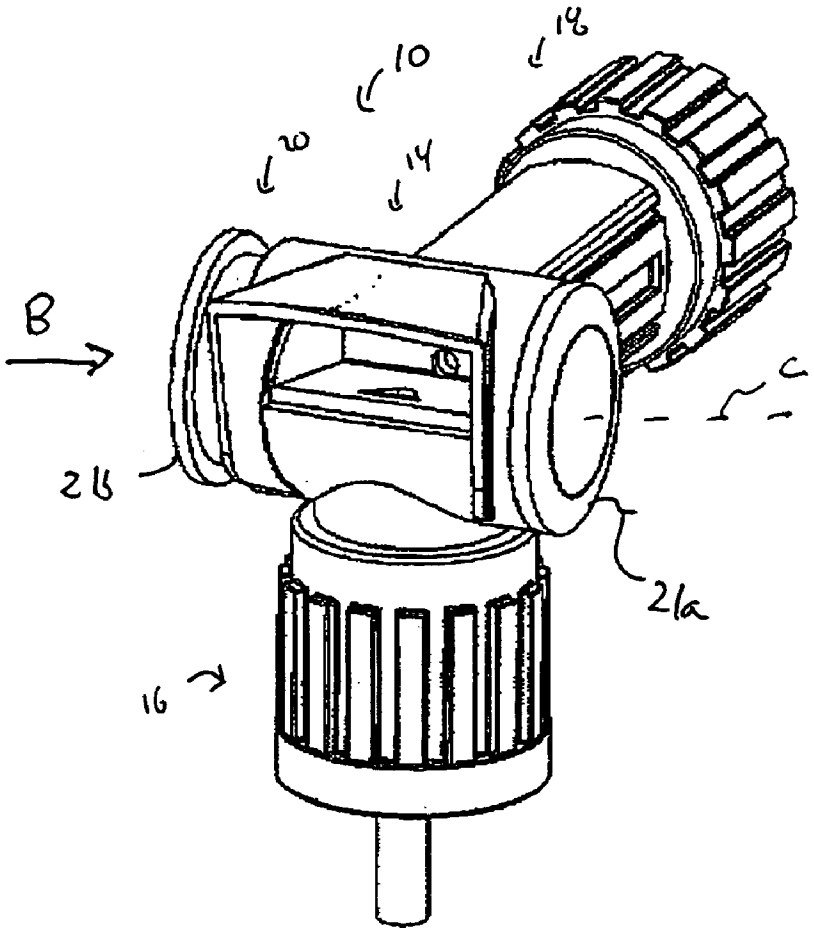
FIG. 5 is a front perspective view of the sprayer head assembly of FIG. 1 in an open position.
Figure 6:
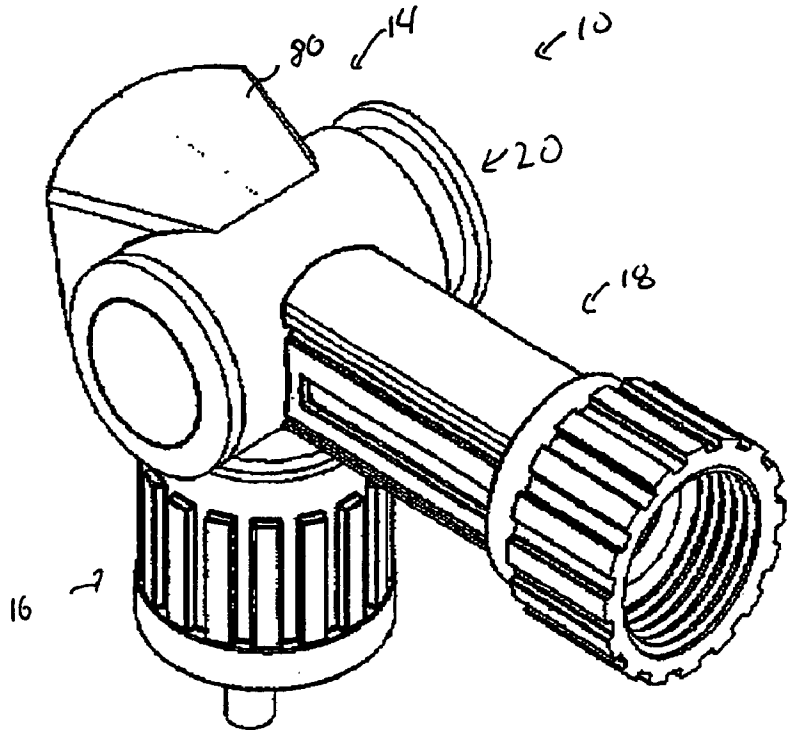
FIG. 6 is a side perspective view of the sprayer head assembly of FIG. 1 in an open position.

With reference to FIGS. 1, 3 and 5, the valve 20 is moveably positioned in a bore 22 that is formed in the sprayer head 14 of the sprayer head assembly 10. In the illustrated embodiment, the bore 22 is generally cylindrical and the valve 20 is moveable in a side to side motion (see arrows A and B in FIGS. 1 and 5) which is generally transverse to a longitudinal axis of the assembly 10. In the illustrated embodiment, the valve 20 also moves in a direction that is generally horizontal with respect to the user that is holding the assembly 10.

Figure 4:
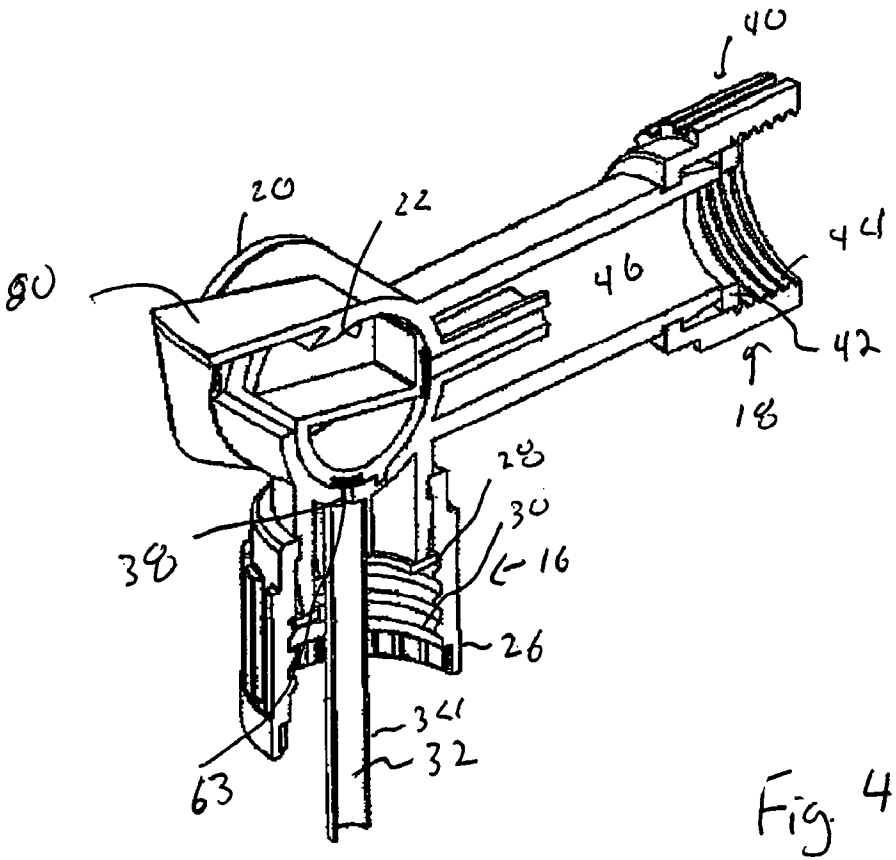
FIG. 4 is a cross-sectional perspective side view of the sprayer head assembly of FIG. 1 in a closed position.

With reference FIGS. 1, 3 and 4, the connection between the sprayer head assembly 10 and the container can be achieved by providing the container connection portion 16 with a conventional rotatable coupler 26 and a washer 28. The rotatable coupler 26 includes internal threads 30 that cooperate with corresponding threads (not shown) formed on the neck of the container.

The sprayer head assembly 10 can also be permanently attached to the container. In such an arrangement, adhesive 17 can be applied to the inner surface of the connection portion 16 before it is fitted over the neck of the container. Alternatively, the connection portion 16 can include an inwardly projecting ratchet that opposes a cooperating ratchet formed on the container.

When the sprayer head assembly 10 is installed onto a container, the interior of the container is in communication with a chemical passage 32 that is also in communication with the interior of the cylindrical bore 22. In the illustrated arrangement, the chemical passage 32 is defined in part by a downwardly depending chemical flow tube or dip tube 34. The dip tube 34 extends into the container and preferably terminates near a bottom surface of the container. The chemical passage 32 is also defined in part by an internal passage 38, which is formed in the sprayer head 14. The internal passage 38 communicates with the interior of the cylindrical bore 22 and the dip tube 34. The dip tube 34 is secured in fluid communication with the internal passage 38 by a cylindrical boss 36 (see FIG. 3). Although, in the illustrated arrangement the chemical passage 32 is defined by two components (the dip tube 34 and the internal passage 38), it should be appreciated that the chemical passage 32 can be defined by a single component or more than two components. For example, the dip tube 34 may be integrally formed with the body of the sprayer head 14. The illustrated arrangement, however, is preferred because it is easy to manufacture and yet uses a small number of components.

Preferably, the sprayer head assembly 10 includes a vent passage 52, which is shown in FIG. 10. In the illustrated arrangement, the vent passage 52 is defined by a small hole formed in the head 14 of the assembly. As with the chemical passage 32, the vent passage 52 communicates with the interior of the container when the assembly 10 is mounted onto the container. The vent passage 52 extends up through head 14 and communicates with the interior of the cylindrical bore 22. In the illustrated embodiment, the vent passage 52 lies generally parallel to and spaced along the axis of the valve from the interior passage 32. Although, in the illustrated arrangement the vent passage 52 is formed on the assembly 10, it should be appreciated that the vent passage 52 can be located on the container. However, the illustrated arrangement is preferred because, as will be explained below, it allows the vent passage 52 to be opened and closed with the chemical passage 32.

As mentioned above, the sprayer head assembly 10 also includes the supply fluid connection portion 18 (see FIG. 3). The supply fluid connection portion 18 connects the assembly to a pressurized supply fluid source. In the illustrated arrangement, the connection is formed by a conventional rotatable coupler 40 and a washer 42. The coupler 40 includes threads 44 that cooperate with corresponding threads (not shown) formed on the supply fluid source. One of ordinary skill in the art will appreciate that other configurations can be used to connect the assembly 10 to the supply fluid source.

With reference to FIGS. 3 and 4, the sprayer head assembly 10 defines a supply passage 46. The supply passage 46 is in communication with the supply fluid source and the interior of the bore 22. In the illustrated arrangement, the supply passage 46 is defined in part by a side wall 48 of the sprayer head 14. The side wall 48 extends from the coupler 40 towards the cylindrical bore 22.

As seen in FIGS. 11 and 12, the illustrated valve 20 comprises a wall 54 that defines a cylindrical periphery 53 for sliding engagement with the bore 22. Preferably, the outer wall 54 includes a rib or key 51 that is configured to fit within a corresponding longitudinal groove 55 (see FIG. 10) formed in the bore 22. The interaction between the rib 51 and the groove 55 guides the side to side movement of the valve 20 and limits rotation of the valve 20 in the bore 22. In one embodiment, the groove 55 is generally parallel to the axis of movement C (see FIG. 5) of the valve 20. The valve 20 preferably includes a pair of enlarged portions 21*a* at the opposing ends of the valve 20. The function of the enlarged portions will be described below.

As will be explained below, the valve 20 controls the flow of chemical through the assembly 10. The valve 20 also preferably controls the flow of supply fluid through the assembly 10. More preferably, the valve 20 also controls the communication of the vent passage 52 with atmospheric pressure.

Figure 7:
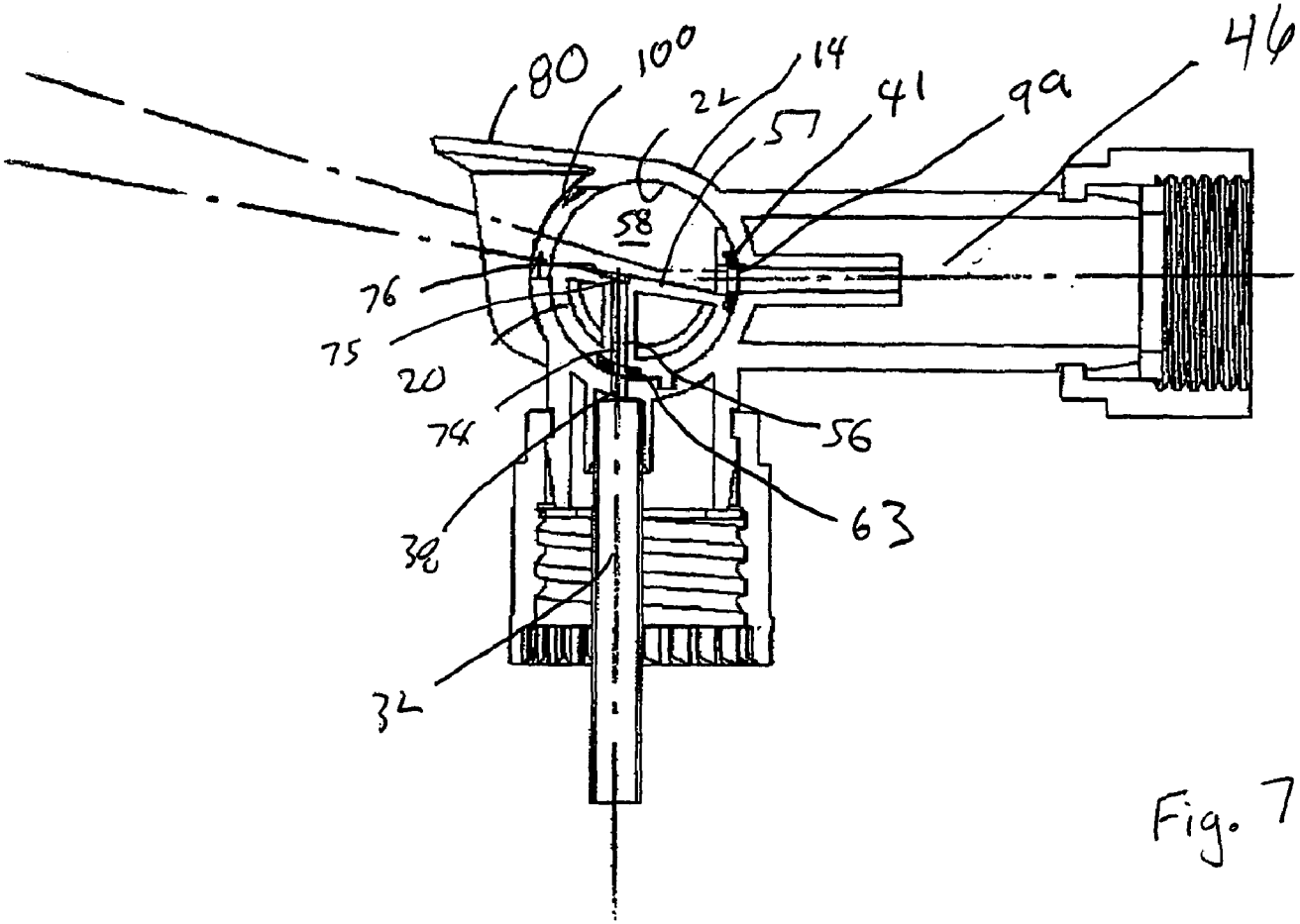
FIG. 7 is a cross-sectional side view of the sprayer head assembly of FIG. 1 in an open position.
Figure 8:
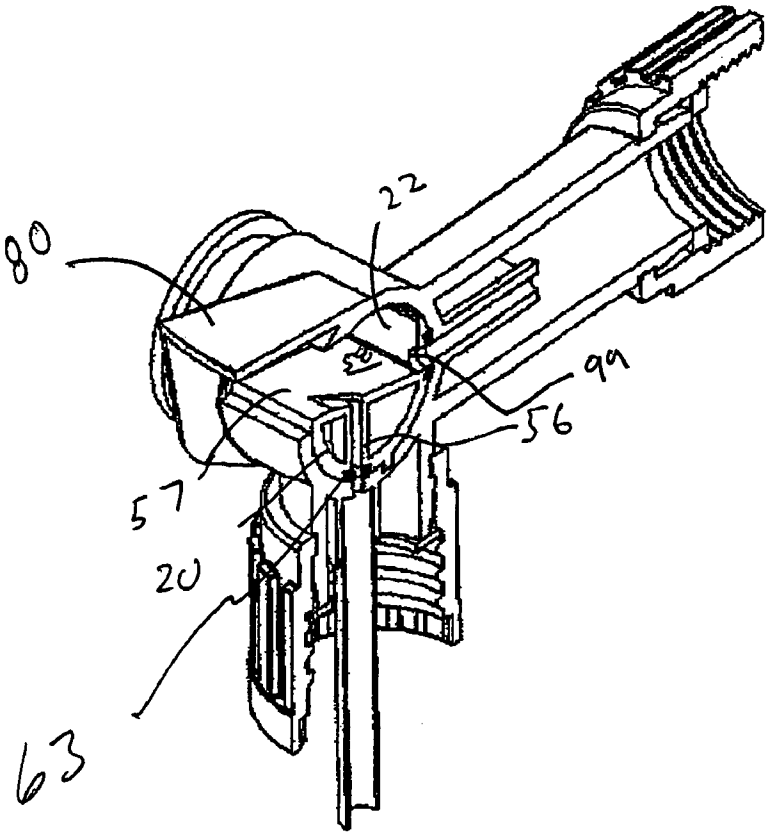
FIG. 8 is a cross-sectional perspective side view of the sprayer head assembly of FIG. 1 in an open position.
Figure 9:
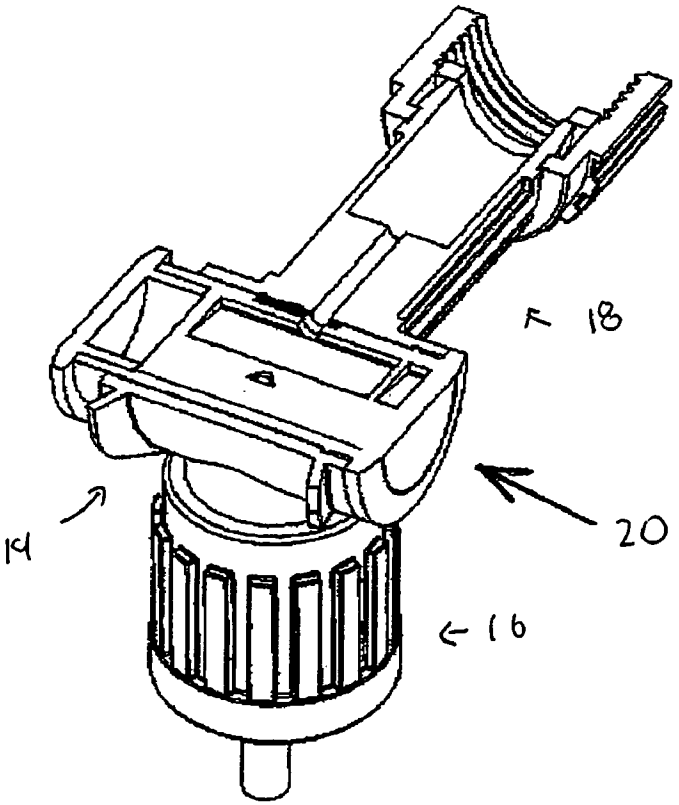
FIG. 9 is a is a cross-sectional front view of the assembly of FIG. 1 in an open position.

Accordingly, as best seen in FIGS. 7 and 8, the valve 20 defines at least in part a first passage 56. The first passage 56 is configured and positioned within the valve 20 such that when the valve 20 is an open position (i.e., the position shown in FIG. 7) the first passage 56 is in communication with the chemical passage 32. In the illustrated embodiment, the first passage 56 is placed in communication with the chemical passage by aligning its inlet with the outlet of the chemical passage 32.

The first passage 56 preferably includes a cylindrical metering orifice (not shown) that preferably terminates within a graduated suction generating recess 76, which is formed on a valve surface 57. Preferably, the valve 20 defines the metering orifice, the suction generating recess 76 and the valve surface 57. However, it should be appreciated that several advantages of the embodiment can be achieved in an arrangement where the metering orifice, the suction generating recess 76 and/or the valve surface 57 are not defined by the valve 20. The illustrated arrangement is preferred because, as will be explained in more detail below, the metering orifice can be more accurately manufactured. For example, in one embodiment the metering orifice can be formed in the sprayer head 14.

The diameter of the metering orifice represents the narrowest cross-sectional area encountered by the chemical moving through the assembly. As such, the metering orifice determines, for the most part, the dilution ratio of the sprayer head assembly 10. The method for determining the diameter of the metering orifice to achieve a desired dilution ratio is well known to those of ordinary skill in the art; therefore, a detailed description of such a method is not necessary.

As seen in FIGS. 7 and 8, the valve surface 57 defines a generally inclined surface within the valve 20. The recess 76 is formed in the surface 57. The recess 76 has a generally triangular shape that is formed by two side walls and a rounded end wall. Preferably, a mouth of the metering orifice (not shown) lies on a lower face of the recess 76 near the rounded end wall. The recess 76 is deepest at the apex where the mouth 75 of the metering orifice is located. The graduated suction generating recess 76 is sized and configured, as is well known in the art, so that when carrier fluid flows over the 76 recess a suction force is created. The suction force draws the chemical from the container through the chemical passage 32. Of course, one of ordinary skill in the art will recognize that the desired suction force can be created with graduated suction generating recesses of other shapes and sizes and in some embodiments without a suction generating recess.

As seen in FIGS. 7 and 8, the valve 20 also defines, at least partially, a second passage 58 that is in communication with the supply passage 46 when the valve 20 is in the open position. The second passage 58 is preferably defined at least in part by an opening 99 formed in the wall 22 of the valve 20, the valve surface 57 and the inner surface of the cylindrical bore 22. It should also be appreciated that the second passage 58 can be defined entirely by the valve 20. That is, interior surface of the cylindrical bore 22 can be replaced, wholly or in part, by an additional wall of the valve 20. However, the illustrated arrangement is preferred for several reasons. For example, this arrangement reduces the amount of material needed to form the valve 20 and increases ease of manufacturing.

In the illustrated embodiment, the second passage 58 is placed in communication with the supply passage 46 by aligning the inlet of the second passage 58 (i.e., the opening 99) with the outlet 3 (see FIG. 10) of the supply passage 46. In this position, the outlet of the second passage 58 is also in communication with a discharge opening 90 formed in the sprayer head 14. The fluid traveling through the second passage 58 in the bore 22 flows through the discharge opening 90 and is discharged from the assembly 10.

With continued reference to FIGS. 7 and 8, the valve 20 forms a sealing portion 63 that forms at least in part an annular seal with the bore 22 around the interface between the chemical passage 32 and the first passage 56. Accordingly, the connection between the chemical passage 32 and the first passage 56 is sealed and chemical is prevented from leaking into the gaps between the valve 20 and the cylindrical bore 22.

Figure 13:
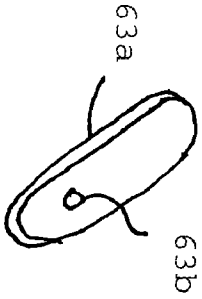
FIG. 13 is a side perspective view of a first sealing member of the assembly of FIG. 1.
Figure 15:
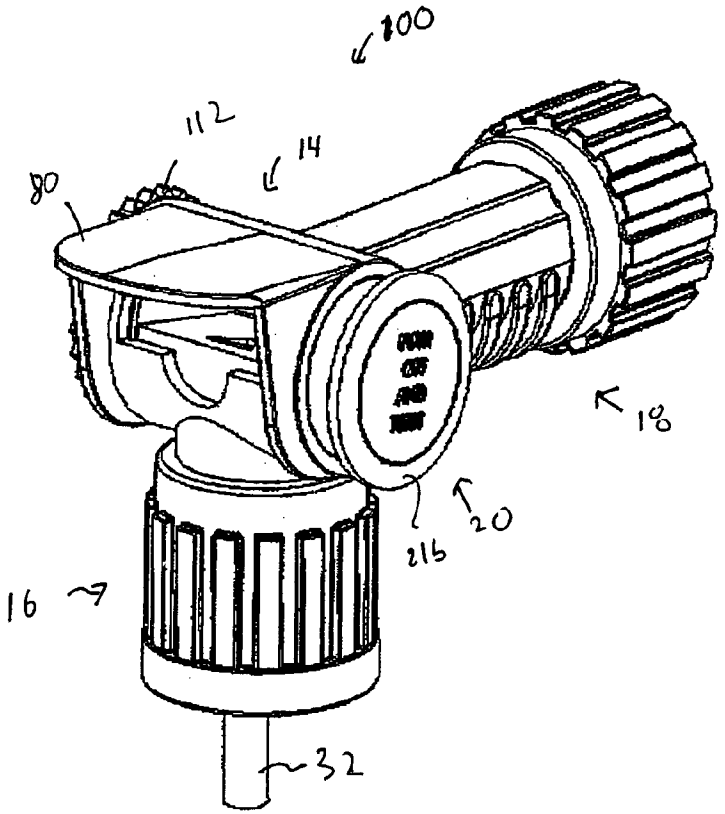
FIG. 15 is a front perspective view of another embodiment of a sprayer head assembly in a closed position.

The sealing portion 63 may be formed in several different manners. In the illustrated embodiment, the sealing portion 63 is formed from a separate sealing pad 63*a* that is positioned within a recess 11 (see FIG. 11) formed on the valve 20. As such, the sealing pad 63*a* moves with the valve 20 as it is moved from the open to closed positions. With reference to FIG. 13, the sealing member 63*a* includes an opening 63*b*, which is aligned with the first passage 56 and with the chemical passage 32 when the valve 20 is in the open position. The sealing pad 63*a* in such an embodiment is preferably made of a soft plastic elastomer material or other suitable synthetic rubber material. Such material provides an effective seal with the bore 22, which as mentioned above is preferably made of a harder plastic material. In another embodiment, a sealing pad or O-ring (not shown) may be positioned within a recess formed in the bottom wall 23 (see FIG. 10) of the sprayer head 14. In other embodiments, the valve 20 and/or the bore 22 may be may be coated with an elastomer, rubber or rubber like material. In another embodiment, the wall 54 of the valve 20 forms the sealing portion 41. In such embodiments, a seal may be formed with a sealing member on the bore 22 and/or by forming or coating the bore 22 and/or valve 20 with seal promoting material.

In the open position, the vent passage 52 is in communication with a vent opening or channel 55*a* (see FIG. 10) in the valve 20. In the open position, the vent channel 55*a* extends beyond the bore 22 to place the vent passage 52 in communication with an atmospheric pressure source.

As shown, in FIGS. 3 and 4, in a closed position, the first passage 56 and the vent channel 55*a* are not in communication with the respective vent and internal passages 52, 38. In the illustrated embodiment, the vent channel and first passage 55*a*, 56 are placed out of communication with the vent and internal passages 52, 38 by sliding the valve such that portions of the valve 20 cover or block the outlets of these passages 52, 38. In the illustrated embodiment, the portion of the valve 20 that blocks these passages 55*a*, 56 is the sealing portion 63 described above. That is, as the valve 20 is moved to the closed position, the sealing portion 63 slides over the outlet of the vent and chemical passages 55*a*, 56. In modified embodiments, the valve 20 may be arranged to block only one of the passages 38, 52. As discussed above, those of skill in the art will also recognize that the valve 20 or the inner bore 22 may be provided with various combinations of sealing members, coatings and/or integrally formed pieces preferably made from a elastic material (e.g., elastomer, rubber or rubber like material) to provide modified sealing arrangements in the closed and open positions. In such embodiments, the outer surfaces of the valve 20 may block the vent and/or chemical passages 52, 32.

With reference back to FIGS. 7 and 8, when the valve 20 is in the open position, a stream of pressurized carrier fluid is discharged into the second passage 58. As the carrier fluid flows over the valve surface 57, a suction force is created that draws chemical through the dip tube 34, internal passage 38, and first passage 56 and into the stream of carrier fluid. Venting is provided through the vent passage 52.

Preferably, the chemical and carrier fluid is directly discharged from the assembly 10 through the second passage 58 and the opening 90. A hood 80 may be provided to prevent spraying on the user. The upwardly inclined orientation of the valve surface 57 of the valve 20 also helps to direct the chemical and carrier fluid stream away from the user. It should also be appreciated that an additional outlet nozzle could be added to the assembly 10 to further direct the water and chemical flow. Such a nozzle can extend from the second passage 58 and would offer additional control of the carrier fluid and chemical stream.

When the valve is moved to the closed position (see e.g., FIGS. 3 and 4), the carrier passage 46 is closed by the valve 20. In this position, the valve 20 covers or blocks the carrier fluid passage 46. As discussed above, the inner bore 22 and/or the valve 20 may be configured in a variety of ways to provide a tight seal between the valve 20 and the carrier fluid passages. In the illustrated embodiment, the valve 20 forms a sealing portion 41. In the illustrated embodiment, the sealing portion 41 is formed by a sealing member or pad 41*a* (see also FIG. 14) that is positioned within a recess 43 formed in the valve 20 (see FIG. 13). In this manner, the sealing portion 41 moves with the valve 20 and in the closed positioned is positioned over the outlet of the carrier fluid passage 46. In other embodiments, the valve and/or inner bore 22 may include additional or replacement sealing members (e.g., O-rings), coatings and/or integral formed materials that are configured to prevent leakage past the valve 20 when the valve 20 is in the closed position. In another embodiment, the wall 54 of the valve 20 forms the sealing portion 41. In such embodiments, a seal may be formed with a sealing member on the bore 22 and/or by forming or coating the bore 22 and/or valve 20 with seal promoting material.

As mentioned above, in the open position (see FIGS. 7 and 8), the opening 99 that is formed in the wall 54 of the valve 20 (FIG. 11) is aligned with the outlet 3 of the carrier fluid passage 46 to place the second passage 56 in communication with the carrier fluid passage 46. In the embodiment, to provide a seal between these passages, the sealing pad 41*a* includes an opening 41*b* (see FIG. 14) that is aligned with the carrier passage 46 in the open position. In this manner, the sealing member 41*a* forms an annular seal between the interface of the opening 99 and carrier fluid passage 46 preventing leakage into the bore 22 in the open position. In modified embodiments, the leakage may be prevented or limited by providing the valve and/or bore with any of a variety of combinations of sealing arrangements including coatings on the valve 20 and/or bore 22 and/or sealing member(s) (e.g., O-rings) positioned on the bore 22.

It should be appreciated that the valve 20 advantageously can be operated with one hand while the assembly 10, container, and hose can be controlled with the other hand thereby providing a safe spray operation. The valve 20 is moved between the open and closed position by pushing on the enlarged portions 21*a*, 21*b*. Specifically, with reference to FIG. 1, the valve 20 may be moved from the closed position by pushing on the enlarged portion 21*a* in the direction of arrow A. This causes to valve 20 to slide in the bore 22 to the open position of FIG. 5. From the open position, the valve 20 may be moved to the closed position by pushing on the enlarged portion 21*b* in the direction of arrow B in FIG. 5. In modified embodiments, the valve 20 may be pulled from the closed and/or open position. In such embodiments, the valve 20 may be provided with a grasping member (e.g., a handle) for grasping and pulling the valve 20.

With reference to FIG. 11, the valve 20 may be formed in two portions. The first portion includes one enlarged portion 21*a* and the portions of the valve 20 configured to fit within the bore 22. The second portion includes the other enlarged portion 21*b*, which may be coupled to the first portion after the valve 20 is assembled into the sprayer head 14.

The illustrated assembly 10 described above is particularly adapted to be manufactured by injection molding. Because the assembly 10 will typically be discarded after the chemical in the container is exhausted, the costs of manufacturing the assembly 10 must be low. Injection molding is a particularly low cost method of making parts out of plastic-type materials. Those of ordinary skill in the art will recognize that the sprayer head 14, the container connection portion 16, the supply fluid connection portion 18, the sealing member and the control valve 20 can all be formed using injection molding.

FIGS. 15-22 illustrate a modified embodiment of a sprayer head assembly 100. In these figures, like numbers have been used to designate components that are similar to the components described above with reference to the embodiment of FIGS. 1-14. In addition, in the following description reference will be made only to components that are needed in order to understand certain modifications or changes as compared to the previous embodiment. For components not specifically mentioned, reference may be made to the description above.

With initial reference to FIGS. 15-19, the sprayer head assembly 100 generally includes a sprayer head 14, a container connection portion 16, a supply fluid connection portion 18, and a control valve 20, which can be configured substantially as described above. The valve 20 is moveably positioned in a bore 22 that is formed in the sprayer head 14 of the sprayer head assembly 100. As with the embodiment of FIGS. 1-16, the bore 22 is generally cylindrical and the valve 20 is moveable in a side to side motion which is generally traverse to a longitudinal axis of the assembly 100. In the illustrated embodiment, the valve 20 also moves in a direction that is generally horizontal with respect to the user that is holding the assembly 100.

Figure 16A:
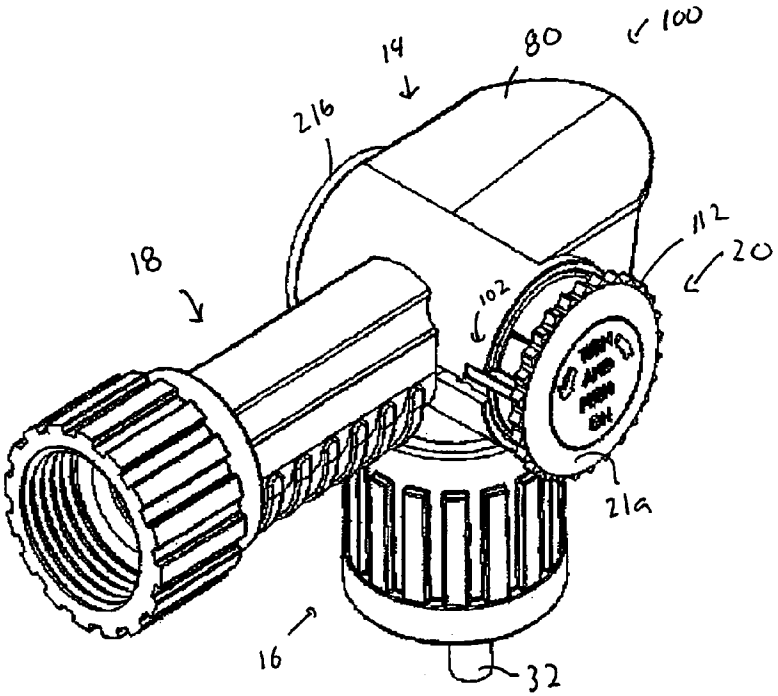
FIG. 16A is a rear perspective view of the sprayer head assembly of FIG. 15 in a closed position.
Figure 16B:
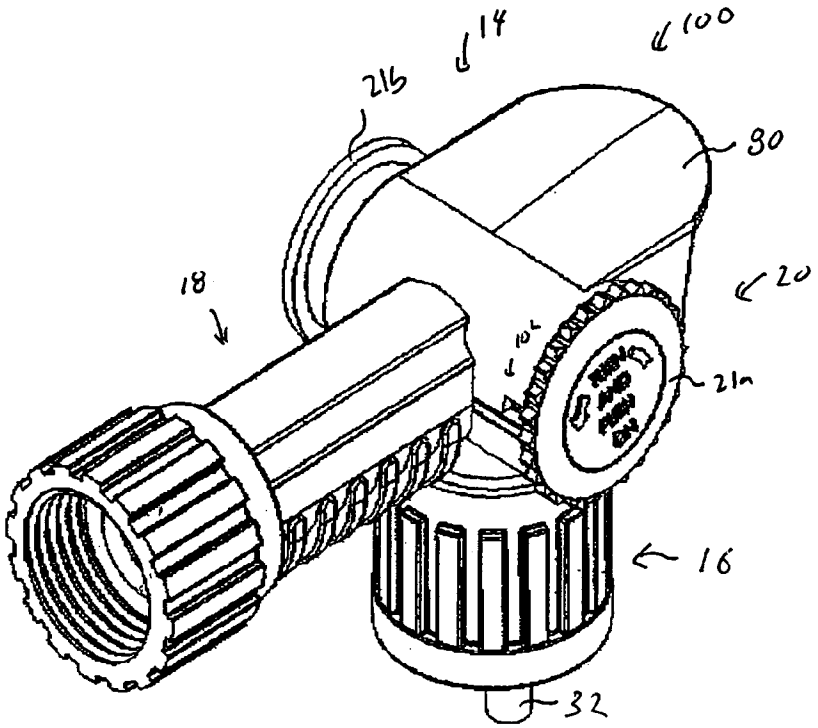
FIG. 16B is a rear perspective view of the sprayer head assembly of FIG. 15 in an open position.
Figure 17:
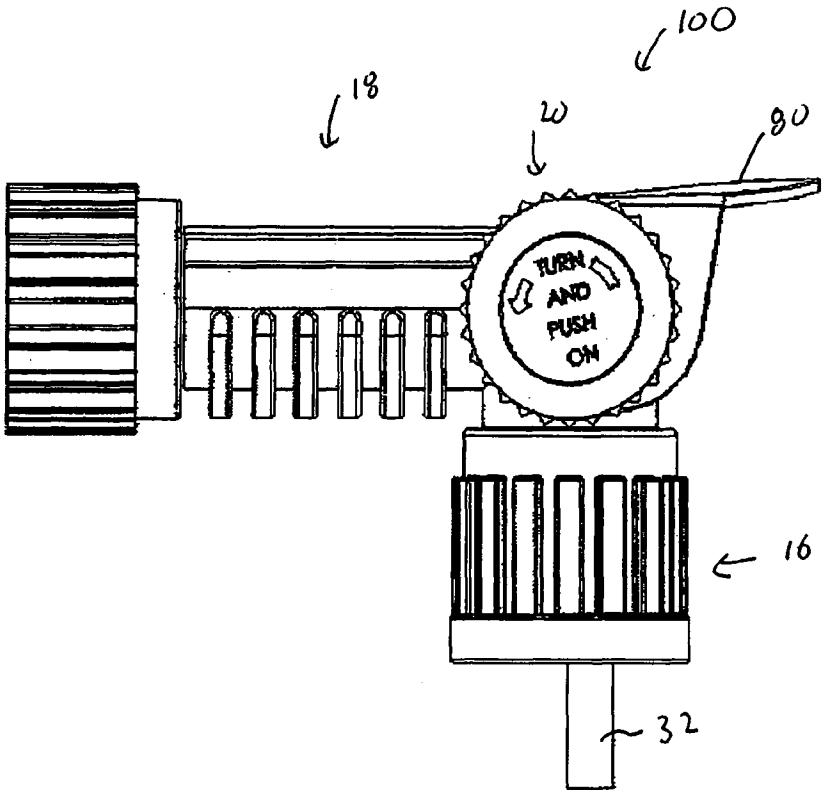
FIG. 17 is a side view of the sprayer head assembly of FIG. 15 in an open position.
Figure 19:
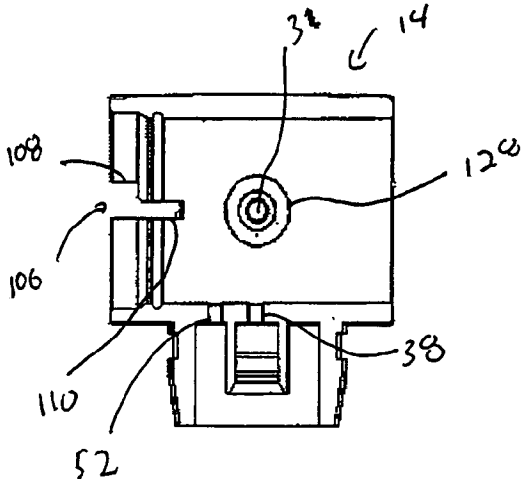
FIG. 19 is a cross-sectional view of the sprayer head assembly taken through line 19-19 of FIG. 18.
Figure 20:
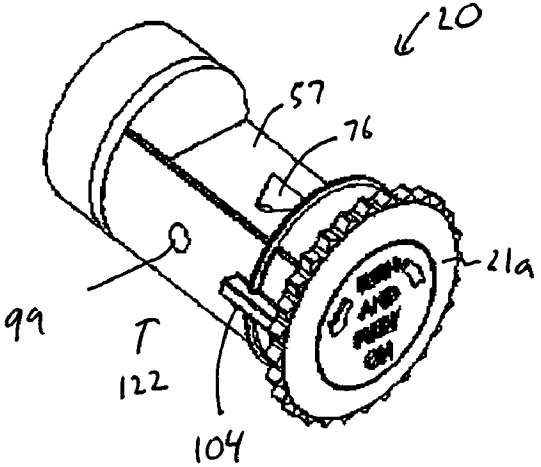
FIG. 20 is a rear perspective view of a valve of the sprayer head assembly of FIG. 15.

In this embodiment, the assembly 100 includes a child safety feature 102, which requires a level of strength and dexterity that is typically not possessed by children in order to operate the valve 20. The child safety feature 102 may comprise any of a variety of interlocking structures. In the illustrated embodiment, the child safety feature comprises a flange 104 positioned on the valve 20, which interacts with a corresponding opening 106 positioned on the sprayer head 14. With reference to the FIGS. 16A and 20, the flange 104 in the illustrated arrangement is positioned on the periphery of the valve 20, has a generally rectangular shape and extends in a direction generally perpendicular to the longitudinal axis of the valve 20. With reference to FIGS. 16A and 19, the opening 106 includes a first, shallow portion 108 and a second extended portion 110. In the closed position (FIG. 16A), the distal end of the flange 104 is positioned in the shallow portion 108 of the opening 106. In this position, the valve 20 cannot be pushed towards the open position in the bore 22. The valve 20 may be provided with a gripping portion (e.g., a knurled area) 112, such that the valve 20 can be rotated within the bore 22. In this manner, the distal end of the flange 104 becomes aligned with the second extended portion 110 of the opening 106. The valve 20 may then be pushed into the open position.

Figure 21:
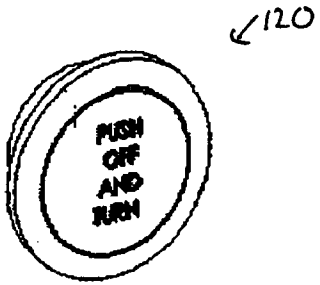
FIG. 21 is a front perspective view of a valve end portion of the sprayer head assembly of FIG. 15.
Figure 22:
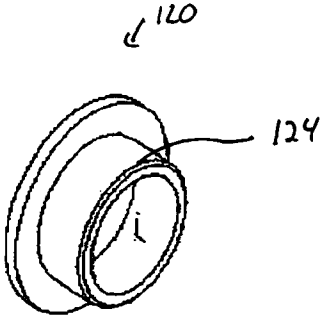
FIG. 22 is a rear perspective view of a valve end portion of the sprayer head assembly of FIG. 15.

As mentioned above with reference to FIGS. 1-14, the valve 20 may comprise a first portion and a second portion. FIGS. 21-22 illustrate the second portion 120 of the valve 20. This portion 120 of the valve 20 maybe coupled to the first portion 122 (see FIG. 20) after the valve 20 has been positioned within the bore 22 of the sprayer head 14. In the illustrated embodiment, the second portion 122 includes an annular flange 124 that may be press-fitted into a corresponding recess (not shown) in the valve 20.

Figure 18:
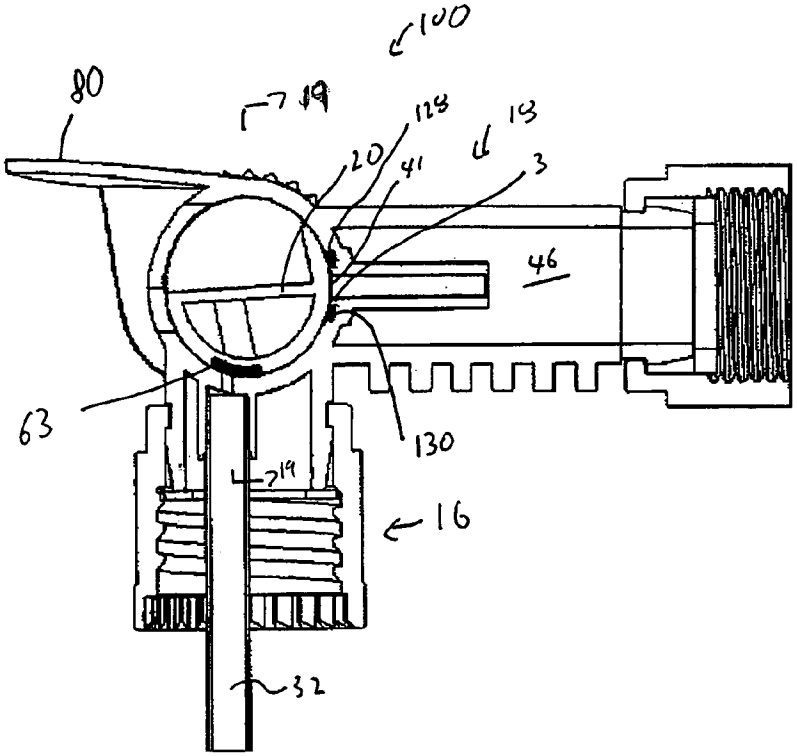
FIG. 18 is a cross-sectional side view of the sprayer head assembly of FIG. 15 in a closed position.

With reference to FIG. 18, in this embodiment, the inner bore includes a recess 128 (see also FIG. 19) in which a sealing member 130 (e.g., an O-ring) is positioned generally about the outlet 3 of the carrier fluid passage 46. In addition the sealing portion 41 is formed by the outer surface of the valve 20. Of course, as described above, a variety of other sealing arrangement may be used in modified embodiments.

Figure 23:
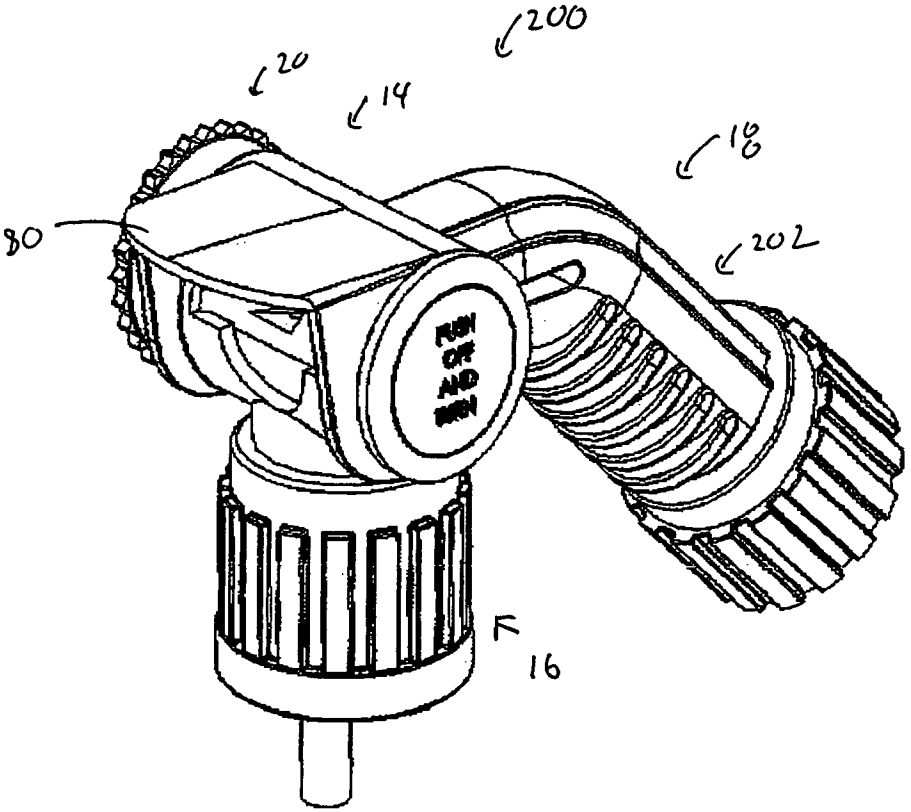
FIG. 23 is a front perspective view of another embodiment of a sprayer head assembly in a closed position.
Figure 24:
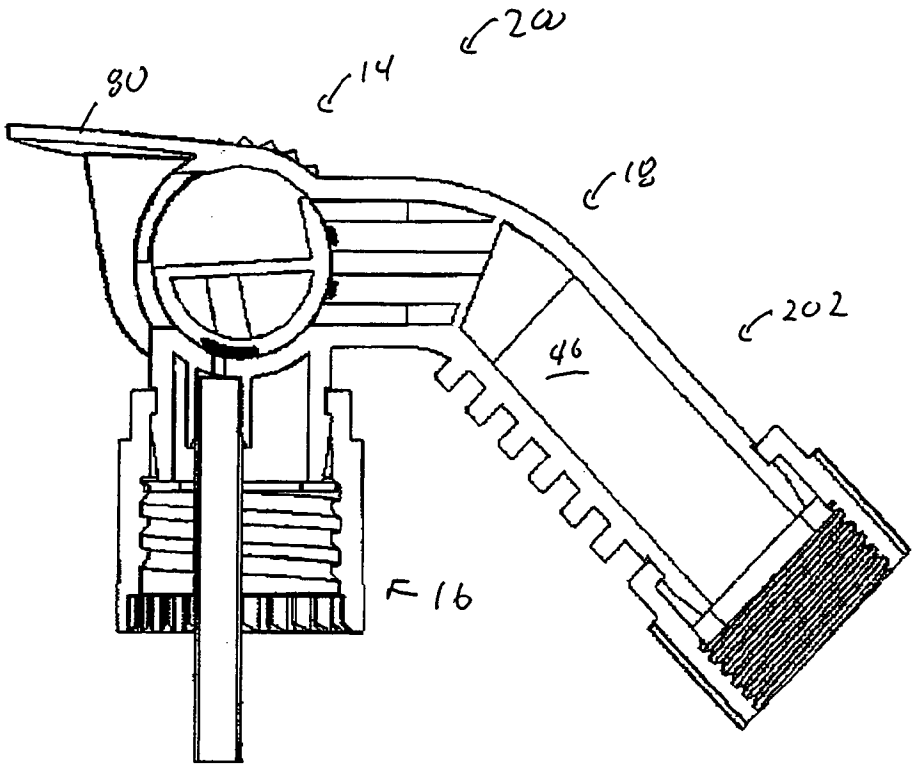
FIG. 24 is a cross-sectional side view of the sprayer head of FIG. 23 in a closed position.

FIGS. 23 and 24 illustrate another modified embodiment of a sprayer head assembly 200. In these figures, like numbers have been used to designate components that are similar to the components described above with reference to the embodiment of FIGS. 1-14. In addition, in the following description reference will be made only to components that are needed in order to understand certain modifications or changes as compared to the previous embodiment. For components not specifically mentioned, reference may be made to the description above.

In this embodiment, the supply fluid connection portion 18 further comprises a downwardly extending portion 202. In the illustrated embodiment, this portion 202 extends at a downwardly directed with respect to the longitudinal axis of the sprayer head 14. In one embodiment, the portion 202 extends along an angle that is between about 30 to about 60 degrees with respect to the longitudinal axis of the sprayer head 14. In another embodiment, the portion 202 extends along an angle that is about 45 degrees with respect to the longitudinal axis of the sprayer head 14. This arrangement may provide a more ergonomically correct positioning of the user's hand with respect to the container that is attached to the sprayer head. This embodiment 200 may also be provided with a child safety feature as described above.

Although this invention has been disclosed in the context of certain preferred embodiments and examples, it will be understood by those skilled in the art that the present invention extends beyond the specifically disclosed embodiments to other alternative embodiments and/or uses of the invention and obvious modifications and equivalents thereof. Thus, it is intended that the scope of the present invention herein disclosed should not be limited by the particular disclosed embodiments described above, but should be determined only by a fair reading of the claims that follow.

What is claimed is:

1. A sprayer head assembly, comprising:
a sprayer head, comprising:
a bore;
a longitudinal groove in the bore;
an internal passage in communication with an interior and exterior of the bore; and
a supply passage in communication with the interior and exterior of the bore;
a container connection;
a supply fluid connection; and
a valve positioned in the bore, comprising:
an outer wall defining a cylindrical periphery;
a first passage through the cylindrical periphery and in communication with an interior of the valve;
a second passage through the cylindrical periphery and in communication with an interior of the valve; and
a rib seated in the longitudinal groove of the bore and slidable therein;
wherein the valve is movable within the bore between an open position wherein the first passage is in communication with the internal passage and the second passage is in communication with the supply passage and a closed position wherein the internal passage is not in communication with the first passage and the supply passage is not in communication with the second passage.

2. A sprayer head assembly, comprising:
a sprayer head, comprising:
a bore;
a supply passage defining a longitudinal axis of the sprayer head assembly and in communication with an interior of the bore;
a container connection portion;
a supply fluid connection portion; and
a control valve in sliding engagement with the bore, wherein the control valve is slidable between an open position and a closed position in a direction transverse to the longitudinal axis of the sprayer head assembly.

3. The sprayer head assembly of claim 2 wherein each of the sprayer head, container connection portion, and supply fluid connection portion comprise polypropylene.

4. The sprayer head assembly of claim 2, wherein the sprayer head further comprises a vent passage in communication with the bore.

5. The sprayer head assembly of claim 2, wherein the container connection portion further comprises a rotatable coupler.

6. The sprayer head assembly of claim 2, further comprising:
a longitudinal groove in the bore; and
a rib on the control valve configured to fit in the longitudinal groove of the bore.

7. The sprayer head assembly of claim 2, wherein the control valve further comprises:
a first passage; and
a second passage.

8. The sprayer head assembly of claim 2, wherein the control valve further comprises:
a valve surface; and
a recess in the valve surface in communication with the first passage.

9. The sprayer head assembly of claim 8, wherein the recess comprises a generally triangular shape.

10. The sprayer head assembly of claim 8, wherein the valve surface comprises a generally inclined surface inclining along a supply fluid path.

11. A sprayer head assembly, comprising:
a sprayer head, comprising:
a bore;
a supply passage defining a longitudinal axis of the sprayer head assembly and in communication with an interior of the bore;
a longitudinal groove in the bore;
a container connection portion;
a supply fluid connection portion;
a control valve slidable in the bore between an open position and a closed position; and
a rib on the control valve, wherein the rib is seated in the longitudinal groove of the bore and slides therein as the control valve slides in the bore.

12. The sprayer head assembly of claim 11, further comprising:
a chemical passage in communication with the bore;
a supply passage in communication with the bore;
a first passage in the control valve, wherein the first passage is in communication with the chemical passage in an open position; and
a second passage in the control valve, wherein the second passage is in communication with the supply passage in an open position.

13. The sprayer head assembly of claim 12, wherein the first passage further comprises a metering orifice.

14. The sprayer head assembly of claim 11, wherein the control valve is moveable along an axis transverse to the longitudinal axis of the sprayer head assembly.

15. A sprayer head assembly, comprising:

a sprayer head, comprising:

a bore;

a supply passage defining a longitudinal axis of the sprayer head assembly, wherein the supply passage is in communication with an interior of the bore; and a longitudinal groove in the bore;

a container connection portion, comprising:

a rotatable coupler; and a washer;

a chemical passage in communication with the bore;

a supply fluid connection portion, comprising:

a supply fluid connection portion rotatable coupler; and a supply fluid connection portion washer;

a supply passage in communication with the bore;

a control valve, comprising:

a wall defining a cylindrical periphery of the control valve, the wall in sliding engagement with the bore;

a rib on an exterior of the wall, wherein the rib is seated in the longitudinal groove of the bore and slides therein as the control valve is moved between open and closed positions;

a first passage, wherein the first passage is in communication with the chemical passage in an open position;

a valve surface on an interior of the control valve;

a recess in the valve surface and in communication with the first passage; and a second passage, wherein the second passage is in communication with the supply passage in an open position.

* * * * *